US006386483B1

(12) United States Patent
Tsai

(10) Patent No.: US 6,386,483 B1
(45) Date of Patent: May 14, 2002

(54) MULTI-FUNCTIONAL STUNT KITE

(76) Inventor: Tien-Ching Tsai, No. 28, Wu Chuan Pa Rd., Wu Ku Industrial Dist., Taipei Hsien (TW)

( * ) Notice: Subject to any disclaimer, the term of this patent is extended or adjusted under 35 U.S.C. 154(b) by 0 days.

(21) Appl. No.: 09/706,852

(22) Filed: Nov. 7, 2000

(30) Foreign Application Priority Data

Sep. 20, 2000 (TW) ..... 89216280 U

(51) Int. Cl.[7] ..... A63H 27/08
(52) U.S. Cl. ..... 244/153 R; 244/155 R
(58) Field of Search ..... 244/153 R, 155 R, 244/155 A

(56) References Cited

U.S. PATENT DOCUMENTS 4,892,272 A * 1/1990 Hadzicki ..... 244/153 R
4,958,787 A * 9/1990 Sterling ..... 244/153 R
6,062,510 A * 5/2000 De La Melena ..... 244/153 R
6,105,903 A * 8/2000 Chen ..... 244/153 R

FOREIGN PATENT DOCUMENTS

DE 4022245 A1 * 10/1991 ..... A63H/27/08

* cited by examiner

*Primary Examiner*—Charles T. Jordan
*Assistant Examiner*—Timothy D. Collins
(74) *Attorney, Agent, or Firm*—Rosenberg, Klein & Lee

(57) ABSTRACT

The present invention provides a multi-functional stunt kite, which has a slightly delta-shaped kite body comprising a plurality of struts and a covering cloth. Two sets of control strings of indeterminate length are connected to points near two lateral wings at the lower side of the kite body. Flying strings on the control strings are exploited to control the flying direction of the kite body two-handedly so that the kite body can make various kinds of stunt flights in the sky. Jointing tubes penetrating from upper side to lower side and a keel strut are joined on the kite body so that the jointing tubes at the lower side can be propped up. Thereby the stunt kite can stand away from the placed plane to be used as a decoration. A fragrant box can also be fixedly installed on the jointing tubes at the upper side of the kite body. Moreover, mobile or fixed bridles are respectively connected to three sides of the top surface of the delta-shaped kite body. Through the fixed bridles, the stunt kite can be hung at a place where air flows so that it can hover, fly, and flip automatically. Moreover, through the change of the hung position of the mobile bridles, the stunt kite can be hung at different angles so that it can make various kinds of stunt flights. The present invention is characterized in that one stunt kite can be controlled single-handedly to make regular rotation or tumbling, and two or more stunt kites can also be controlled single-handedly to make irregular jump or waft simultaneously.

17 Claims, 14 Drawing Sheets

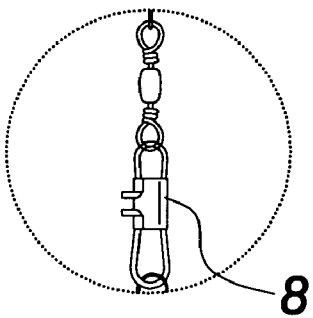
FIG. 5A-b
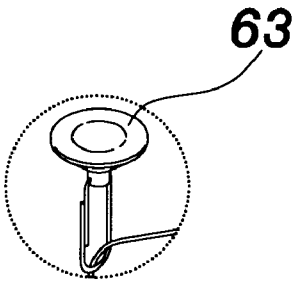
FIG. 5A-a

MULTI-FUNCTIONAL STUNT KITE

FIELD OF THE INVENTION

The present invention relates to a multi-functional stunt kite and, more particularly, to a stunt kite which not only can perform stunt flights outdoors, but also can be installed with a fragrant box or be used as a decoration to be hung at the ceiling or other proper positions of a common residence by means of the improved structure of the present invention when there is no sufficient wind or it is raining. The features of the present invention is that one stunt kite can be controlled to make regular rotation or tumbling, and two or more stunt kites can be controlled to make irregular jump or waft simultaneously. The stunt kite of the present invention can also be hung at a place where air flows such as the place in front of the wind outlet of an air-conditioner or a fan so that it can however, fly, and flip along with the wind.

BACKGROUND OF THE INVENTION

A general stunt kite has a slightly delta-shaped kite body comprising a plurality of struts and a covering cloth. Two sets of control strings are connected to points near two lateral wings at the lower side of the kite body. One end of the control strings are connected to the flying strings and the other end there of join with a handgrip to facilitate grasp for the user. When the stunt kite wafts along with the wind in the sky, the flying strings can be used to control the flying direction of the kite body so that the stunt kite can make various kinds of stunt flights. However, an outdoor stunt kite of prior art can only make stunt flights in the sky outdoors. Although an indoor stunt kite of prior art can be controlled to fly indoors, it requires a spacious and tall space such as a gym or an auditorium, and it must be controlled with two hands. Moreover, the indoor stunt kite is expensive and lightweight, and can't bear larger wind so that it may be damaged easily. Therefore, outdoor stunt kites and indoor stunt kites of prior art have a very limited range of usage. They have no additional values. When they are not used, they can only be stowed up.

SUMMARY OF THE INVENTION

The first object of the present invention is to provide a multi-functional stunt kite having a slightly delta-shaped kite body comprising a plurality of struts and a covering cloth. Two control strings are connected to points near two lateral wings at the lower side of the kite body. The control strings are connected to two flying strings through which the flying direction of the kite body can be controlled two-handedly so that the kite body can make various kinds of stunt flights. The present invention is characterized in that jointing tubes penetrating from upper side to lower side are installed on the kite body so that a long supporting rod, a spring, or a short post of a suction disk can be telescoped in the jointing tubes at the upper or lower side. Thereby, the stunt kite can stand away from the placed plane to dangle along with the wind or the agitation of the body on which it is placed. A suction disk or a weighted block can be installed at the other end of the long supporting rod or the spring. The second object of the present invention is to provide a multi-functional stunt kite, whereby two or more stunt kites can be telescoped and stacked together after supporting rods are telescoped in jointing tubes penetrating from upper side to lower side of the stunt kites.

The third object of the present invention is to provide a multi-functional stunt kite, wherein a propeller can be installed at the front end or the rear end of a keel strut of the kite body, and a gripper can be installed at the other end of the keel strut so as to grip at a wind guide plate of an air-conditioner or a proper position.

The fourth object of the present invention is to provide a multi-functional kite, wherein bridles are installed at the upper side of a slightly delta-shaped kite body of the stunt kite. The bridles are tied to let the stunt kite form a properly slanting angle suitable for flight. The stunt kite is fixedly arranged at a place where air flows such as the place in front of the wind outlet of an air-conditioner or a fan so that the stunt kite can hover, fly, and flip automatically.

The fifth object of the present invention is to provide a multi-functional stunt kite, wherein mobile bridles are respectively disposed at three points on a slightly delta-shaped kite body of the stunt kite. The mobile bridles can be joined at the upper side or the lower side. Each of the mobile bridles has a plurality of positioning points. The upper side or the lower side of the kite body can be selectively hooked at different positioning points so that the stunt kite can exhibit different angles with the upper side or the lower side thereof up. When a single elevating string is pulled, the stunt kite can make continual right or left rotation or continual tumbling indoors where there is no wind. The stunt kite can also make irregular jump, flip, or flight. Therefore, the stunt kite of the present invention is not limited by the condition of wind or place.

The sixth object of the present invention is to provide a multi-functional stunt kite, wherein an elevating string matched with a plurality of strings can be used to pull a plurality of stunt kites to let them jump and fly simultaneously when they are mounted on a hook ring.

The seventh object of the present invention is to provide a multi-functional stunt kite, wherein a fragrant box can be installed at a predetermined position thereof so that the stunt kite can be used as a decoration, which can emit aroma.

The various objects and advantages of the present invention will be more readily understood from the following detailed description when read in conjunction with the appended drawings, in which:

BRIEF DESCRIPTION OF THE DRAWINGS

FIG. 5B is a view showing the situation that a stunt kite of the present invention is hung and pulled;

DETAILED DESCRIPTION OF THE PREFERRED EMBODIMENTS

Figure 1:
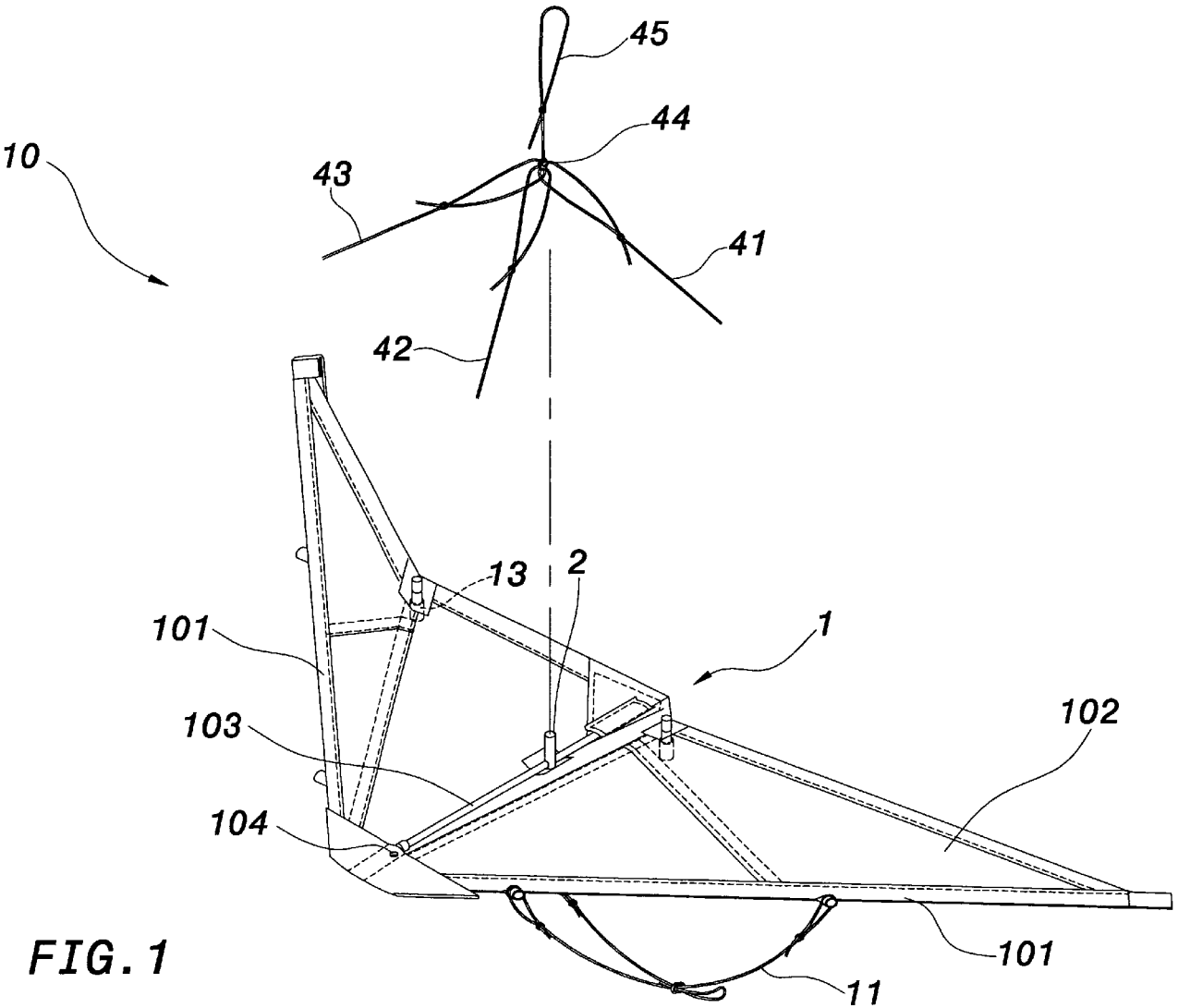
FIG. 1 is an exploded perspective view of the present invention.
Figure 2:
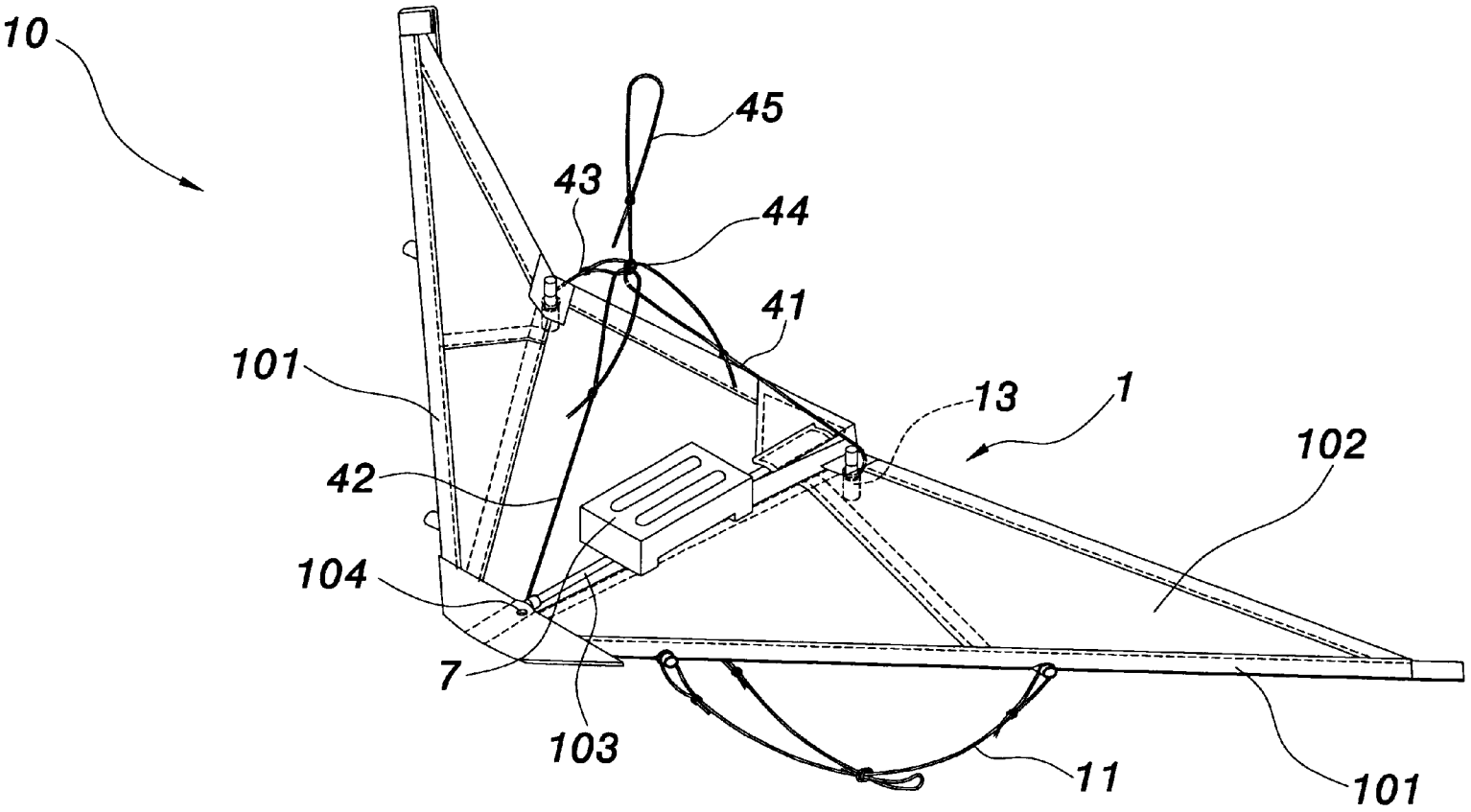
FIG. 2 is a perspective view of the present invention.

As shown in FIGS. 1 and 2, a stunt kite 10 of the present invention, which can be of any size, has a slightly delta-shaped kite body 1 comprising a plurality of struts 101 and a covering cloth 102. The kite body 1 can be roughly divided into a head and two lateral wings. Two sets of control strings are connected to points near the two lateral wings at the lower side of the kite body 1. The control strings are connected to two flying strings through which the flying direction of the kite body 1 can be controlled two-handedly so that the kite body 1 can make various kinds of stunt flights in the sky. Because the main structure of the stunt kite 10 is well known in the art, it will not be further illustrated.

Figure 6A:
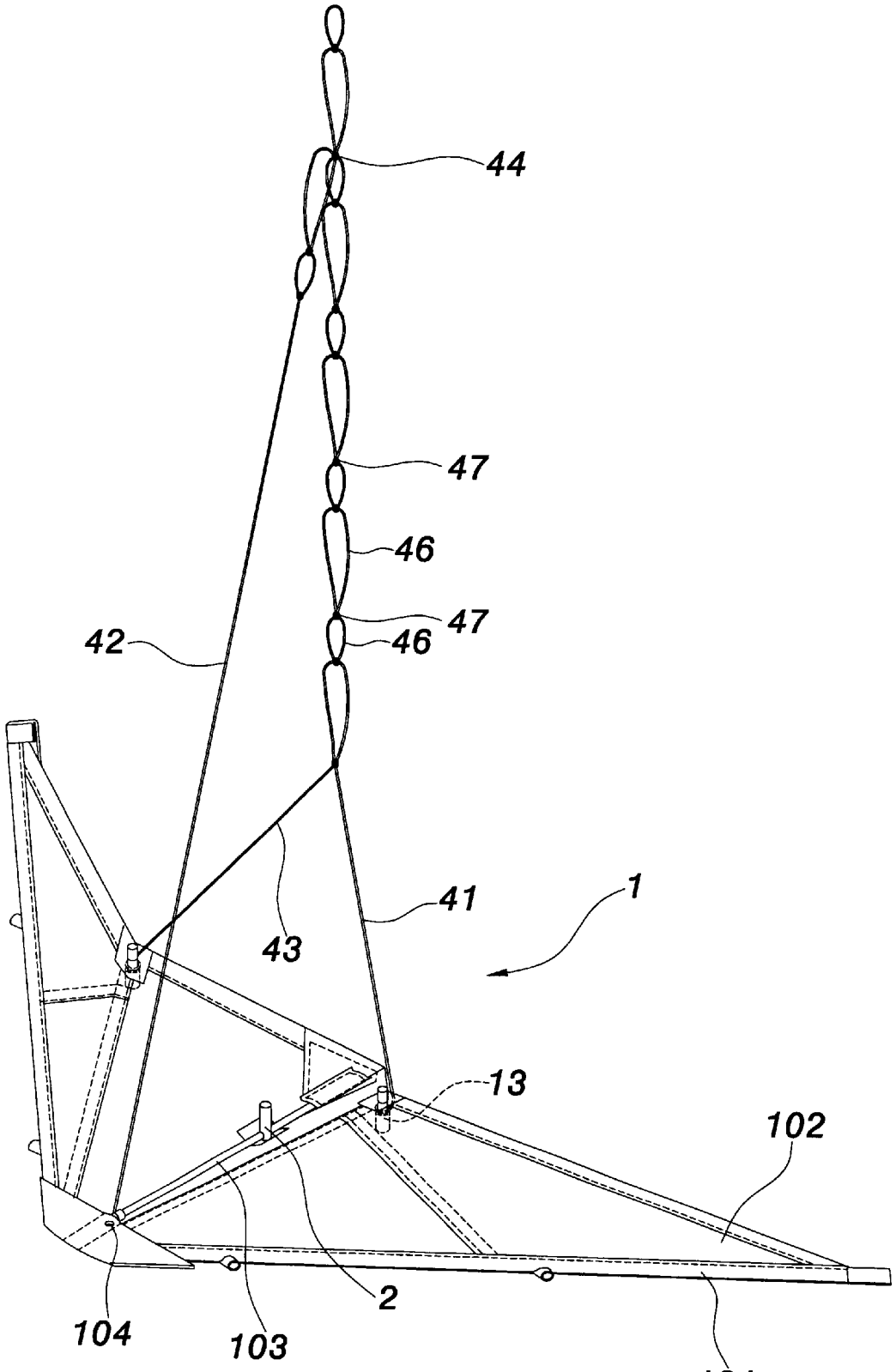
FIG. 6A is a view showing a way how the bridles of the present invention are tied.
Figure 9:
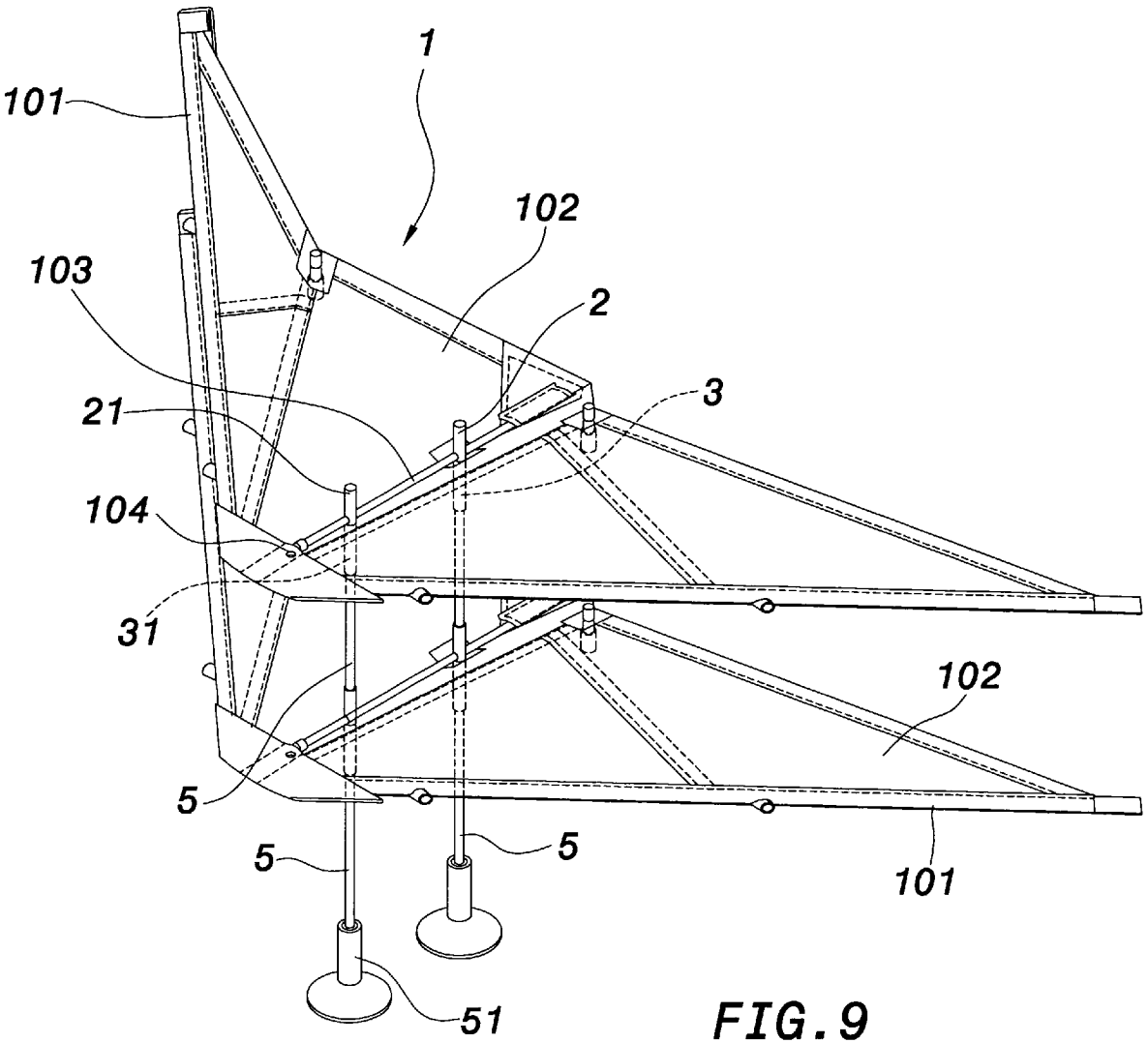
FIG. 9 is a view showing the situation that two stunt kites of the present invention are telescoped and stacked together.

The present invention is characterized in that rear jointing tubes 2 and 3 penetrating from upper side to lower side are joined at the central part of the kite body 1, or front jointing tubes 21 and 31 are further attached at the central part of the kite body 1, as shown in FIG. 9. Bridles 41, 42, and 43 are respectively connected to points on the top surface near the head and the two tails of the kite body 1. One end of the three bridles 41, 42, and 43 are fixedly looped at a keel strut 103 and a supporting strut 108 of the kite body 1. Retaining blocks 13 are telescoped at points where the keel strut 103 and the supporting strut 108 are fixedly joined so as to prevent the bridles 41, 42, and 43 from sliding. The front section of the covering cloth 102 has a string hole 104 so that the bridles 41, 42, and 43 can be placed convertibly at the upper side or the lower side of the stunt kite 10. Another end of the three bridles 41, 42, and 43 are joined together by means of slipknots or a flat knots. Positioning points 46 and positioning knots 47 can be arranged between the slipknots so that the connection point 44 of the three bridles 41, 42, and 43 can be fixed or mobile, as shown in FIG. 6A. A lift string 45 or a positioning point 46 joins with the connection point 44. The lift string 45 or the positioning point 46 is connected to a string so that the hung angle of the stunt kite 10 can be changed along with the change of the position of the connection point 44 or the positioning point 46 of the mobile bridles 41, 42, and 43.

Figure 8:
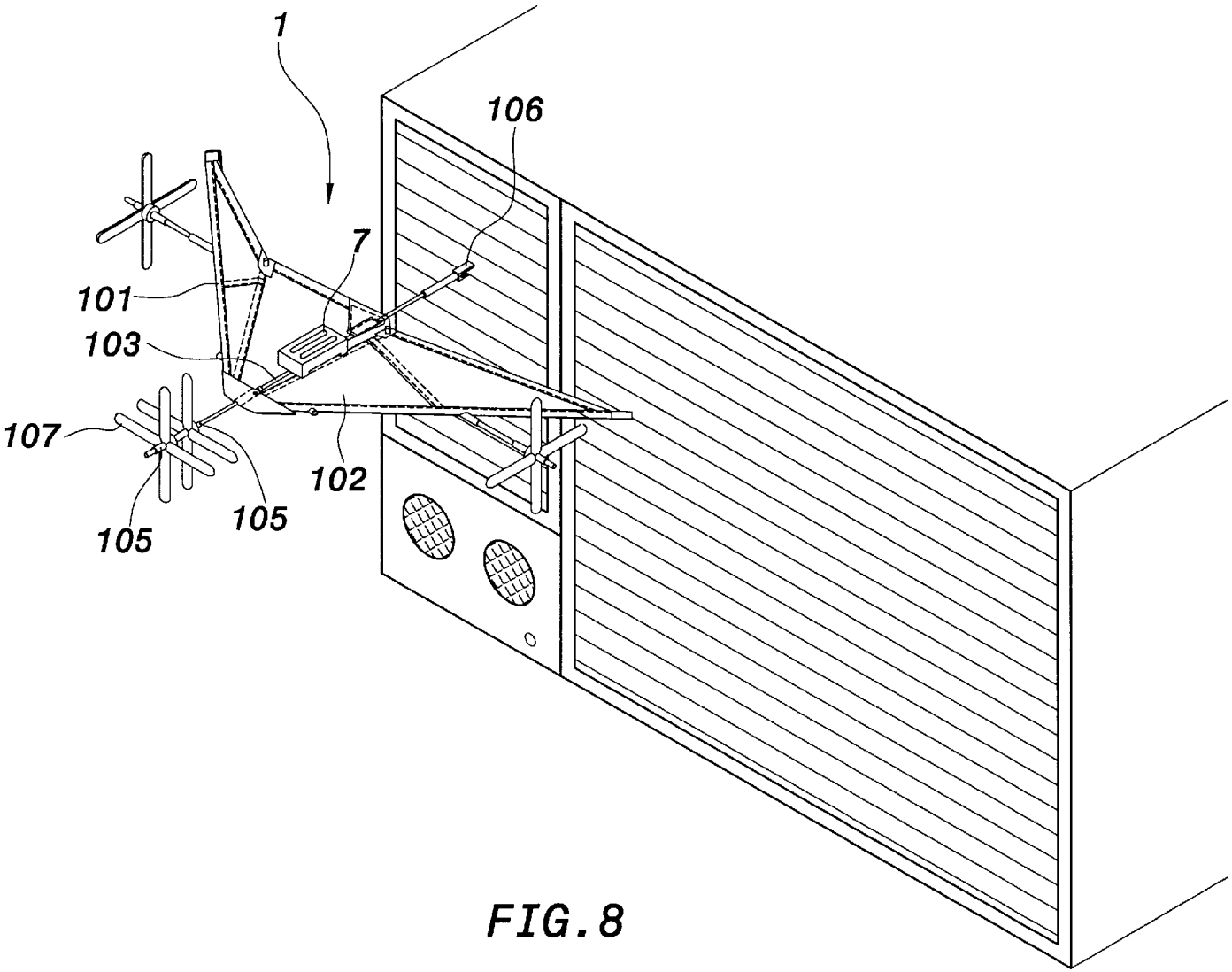
FIG. 8 is a view showing the situation that propellers and a gripper are installed on a stunt kite of the present invention.

As shown in FIG. 8, the upper side of the kite body 1 has a keel strut 103 extending out of front ends and rear ends of the rear jointing tube 2 and the kite body 1. Retaining blocks 13 are installed in the front end and the rear end of the keel strut 103 so as to position it. One or more propellers 104 can be installed at the front end or the rear end of the keel strut 103. Positioning blocks 105 are installed in front of and behind the propeller 104 so as to position it. A gripper 106 can be installed at the other end of the keel strut 103 so as to grip at a wind guide plate of an air-conditioner or a proper position.

As shown in FIG. 9, supporting rods 5 are telescoped in the front jointing tubes 21 and 31 and the rear jointing tubes 2 and 3 respectively installed at the upper side and the lower side of the kite body 1. Thereby, two or more stunt kites 10 can be telescoped and stacked together. Suction disks 51 or weighted blocks 52 can also be telescoped on the stunt kite 10 at the lowest layer.

Figure 3A:
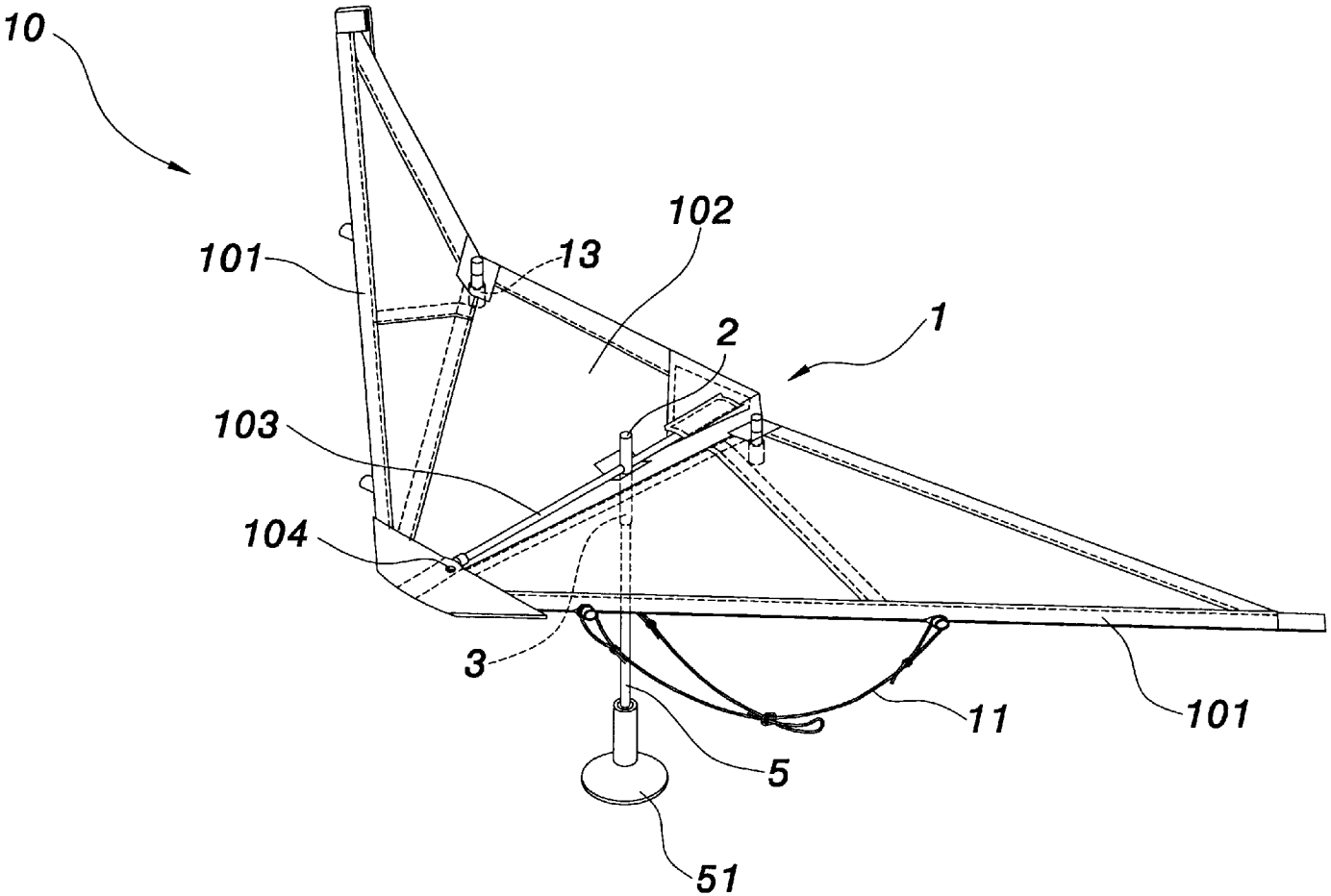
FIG. 3A is a view showing the situation that a suction disk of the present invention uses a long supporting rod.
Figure 3B:
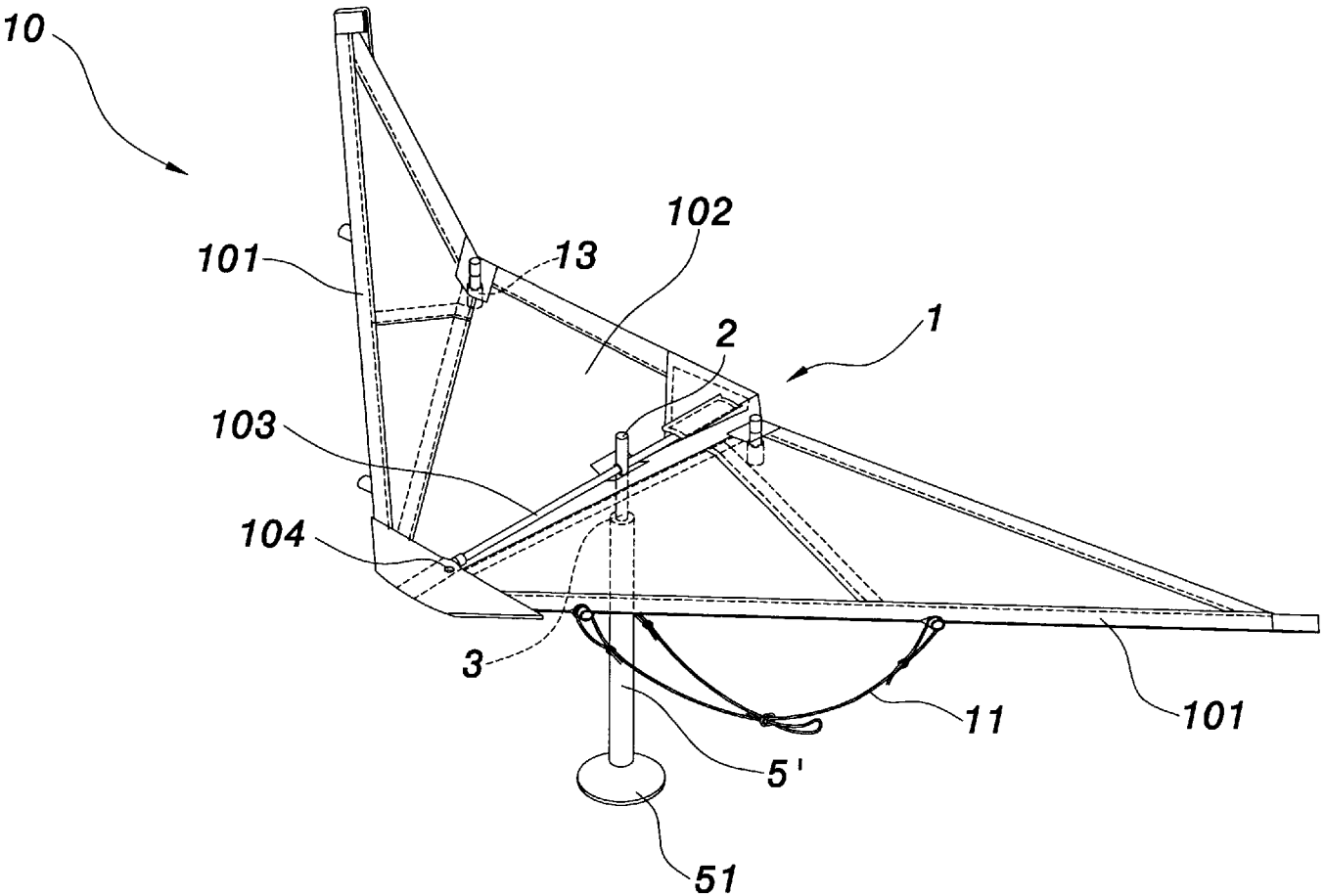
FIG. 3B is a view showing the situation that a post extends from a suction disk of the present invention.
Figure 3C:
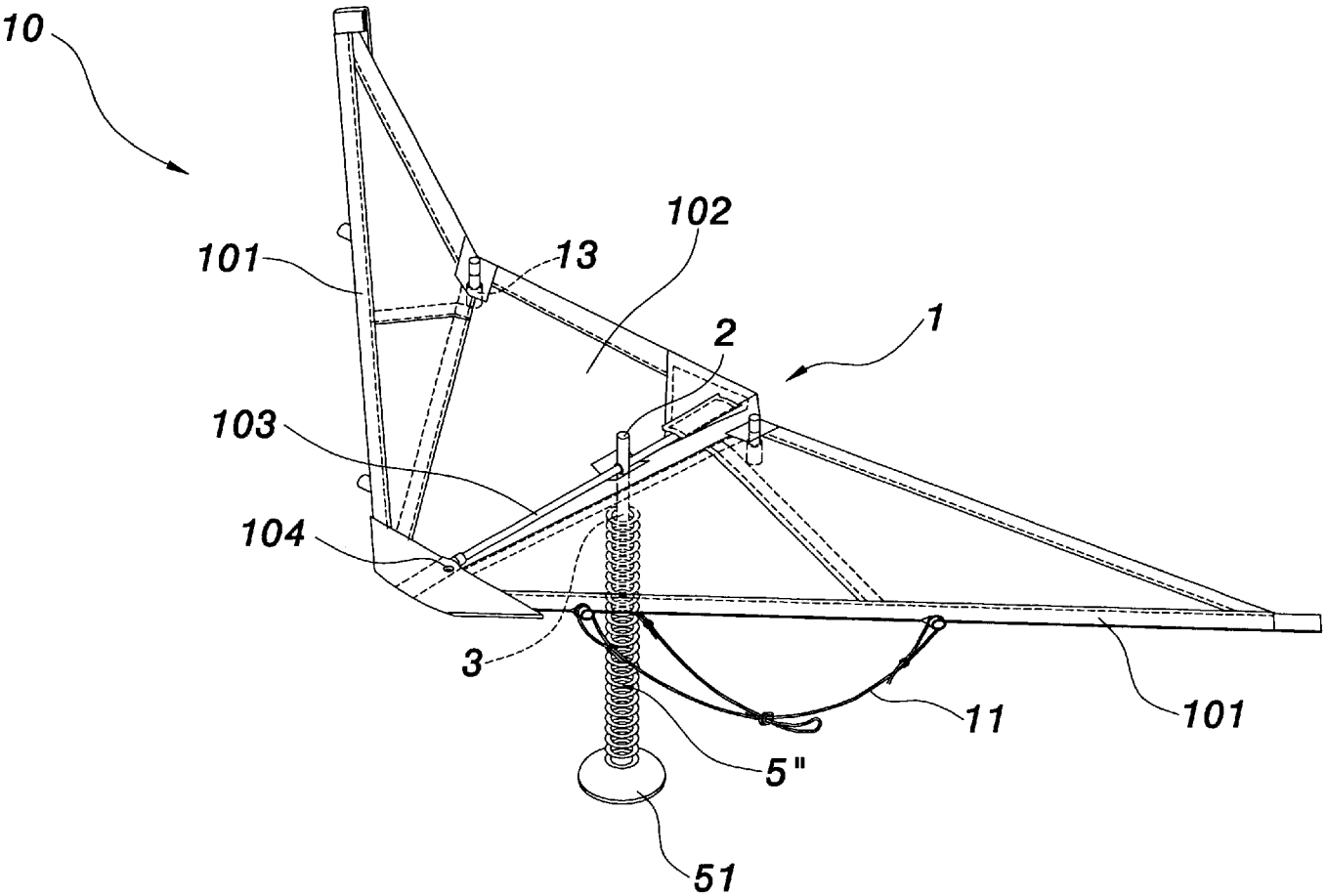
FIG. 3C is a view showing the situation that a suction disk of the present invention uses a spring.
Figure 4:
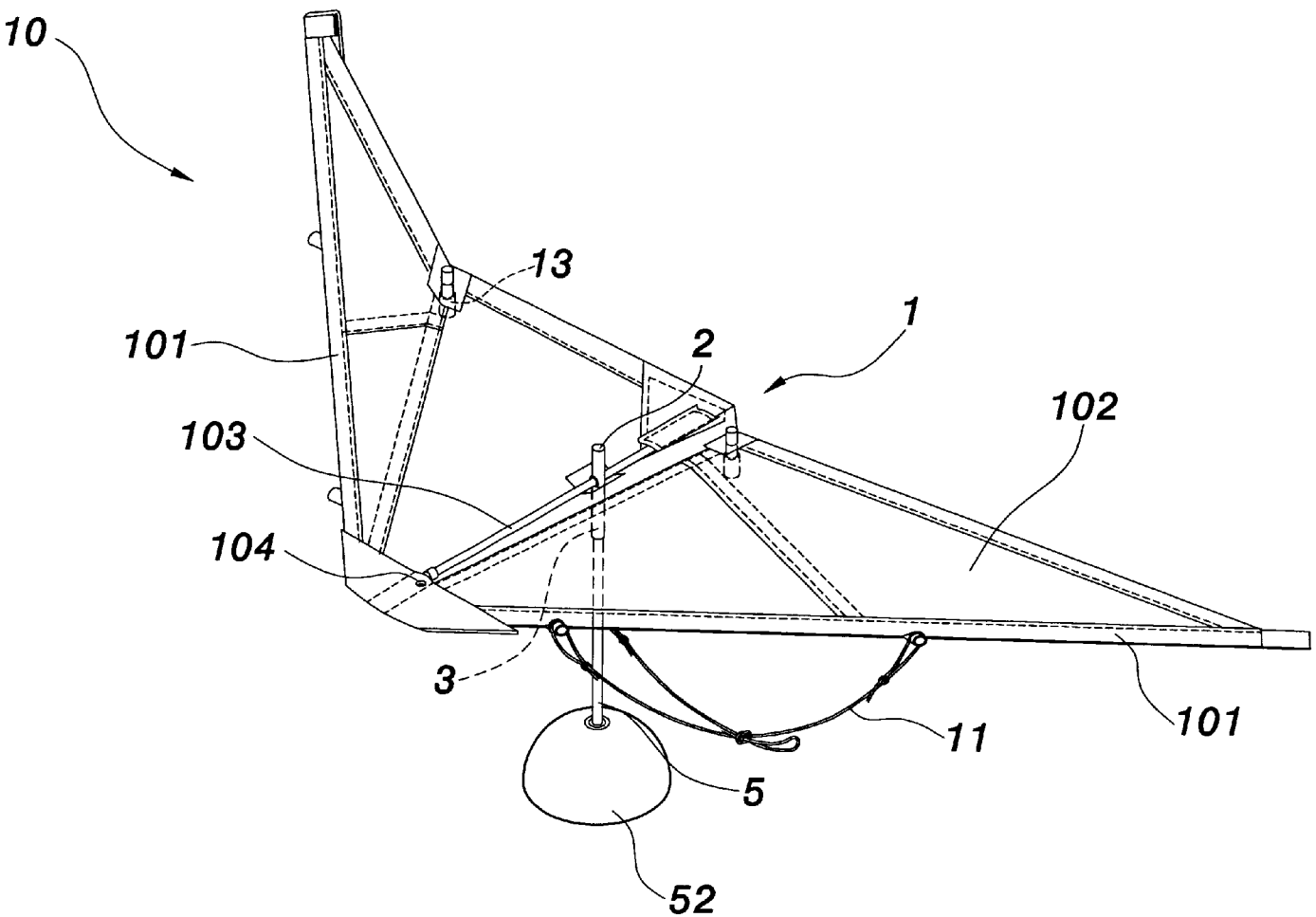
FIG. 4 is a view showing the situation that a weighted block is used in the present invention.

A supporting rod 5 can be telescoped in the rear jointing tube 3 at the lower side of the stunt kite 10, as shown in FIG. 3A. A short post 5' can extend from the suction disk 51, as shown in FIG. 3B. A spring 5" can be installed on the suction disk 51, as shown in FIG. 3C. The other end of the supporting rod 5, the short post 5', or the spring 5" is joined with the suction disk 51 so that the stunt kite 10 can stand away from the placed plane by means of the adhesion force of the suction disk 51. Thereby, the stunt kite 10 can be used as a decoration. FIG. 4 shows another embodiment of the present invention, wherein the other end of the supporting rod 5 or the spring 5" can be inserted in a weighted block 52 or be inserted in a post on the weighted block 52 so that the stunt kite 10 can stand away from the placed plane.

Figure 5A:
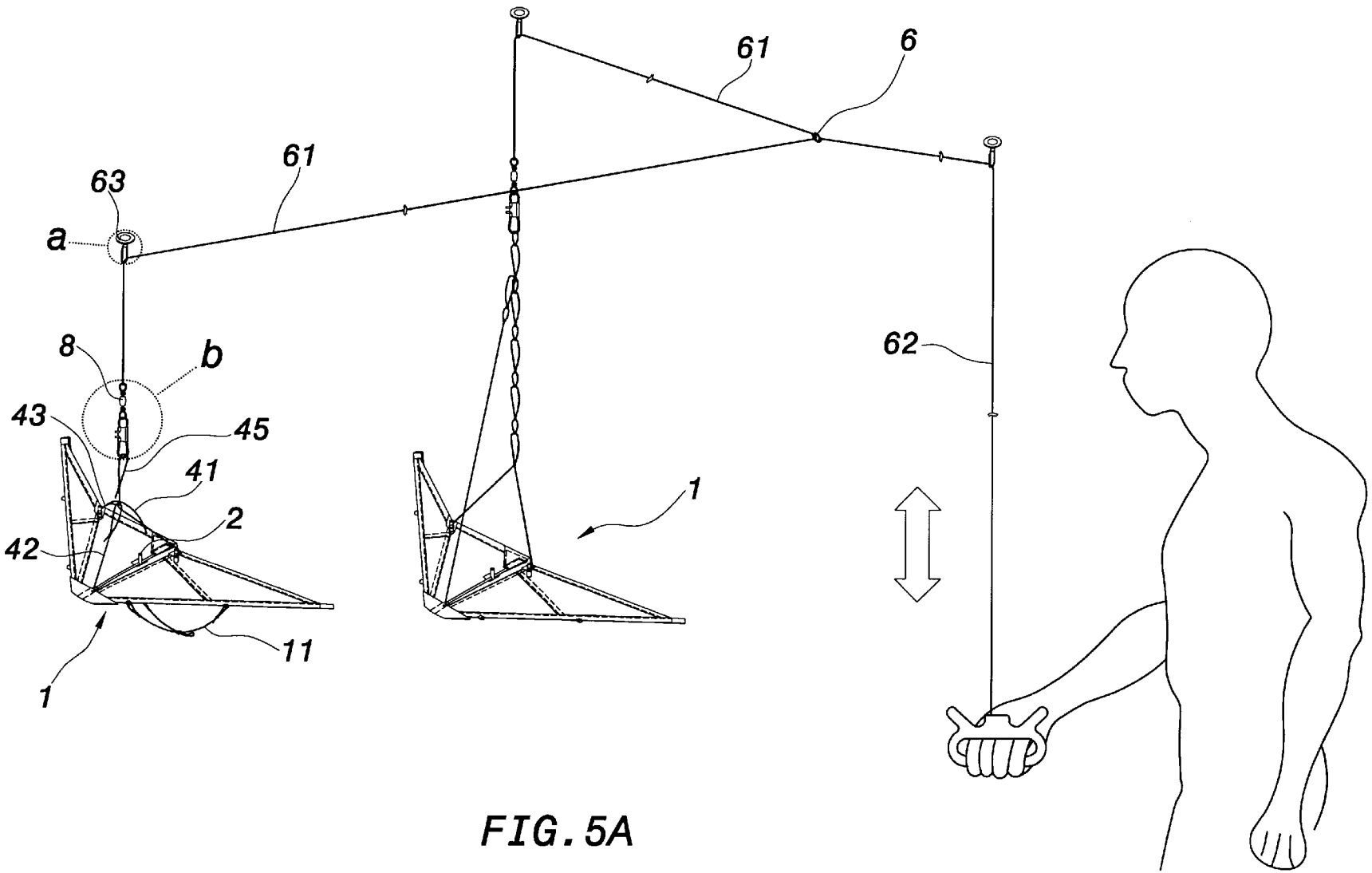
FIGS. 5A and 5A-*a* and 5A-*b* are a view showing the situation that a plurality of stunt kites of the present invention are hung and pulled, wherein the 5A-*a* and 5A-*b* are details in FIG. 5A.
Figure 5B:
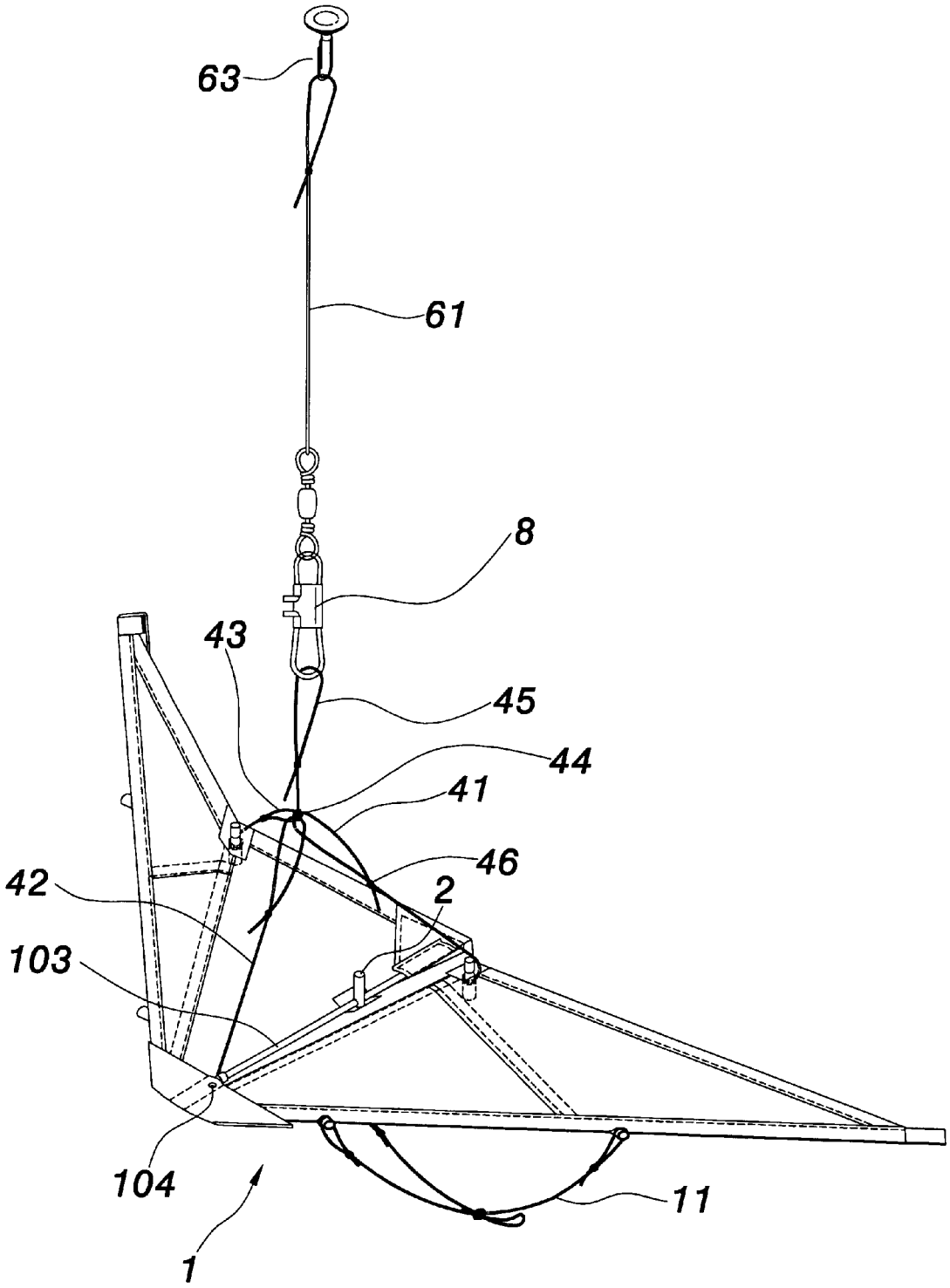

FIGS. 5A, 5A-*a*, and 5A-*b* show yet another embodiment of the present invention, wherein mobile bridles 41, 42, and 43 and the positioning points 46 are tied on the top surface of the kite body 1. Through the hooking of a rotation hook 8 at different positioning points 46, the stunt kite 10 can be hung at different angles and can be lifted or lowered movably. One or more stunt kites can be joined together. When there is only a stunt kite 10, the joining point 6 is not needed. The stunt kite 10 can be pulled to make regular right or left rotation, tumbling, and flight. When there are more than one stunt kites 10, they can be pulled to make irregular jump and flip. As shown in FIG. 5A, a joining point 6 is arranged in the present invention. A plurality of suspended strings 61 are arranged on the joining point 6. The joining point 6 also joins with an elevating string 62. The strings 61 and the elevating string 62 are then guided in a hook ring 63. The hook ring 63 has a crossed point to prevent the guided-in strings from detaching. The hook ring 63 can have a suction disk, an adhesive tape, or a nail so as to be arranged at a ceiling, a girder, or a proper place. The lift string 45 or the positioning point 46 of the stunt kites 10 are respectively telescoped in a rotation hook 8 on the strings 61. Thereby, when the stunt kites 10 rotate, the rotation hook 8 will also rotate so as to prevent the bridles 41, 42, and 43, the strings 61, and the elevating string 62 from tangling. Hooks 81 can be used to facilitate the detachment and the hanging of the stunt kites 10 from the lift string 45 and the change of the positioning points 46. Of course, rubber bands or resilient devices can be arranged between the rotation hooks 8 and the lift string 45 and the positioning points 46 to let the stunt kites have better resilient and buffering effects.

Figure 6B:
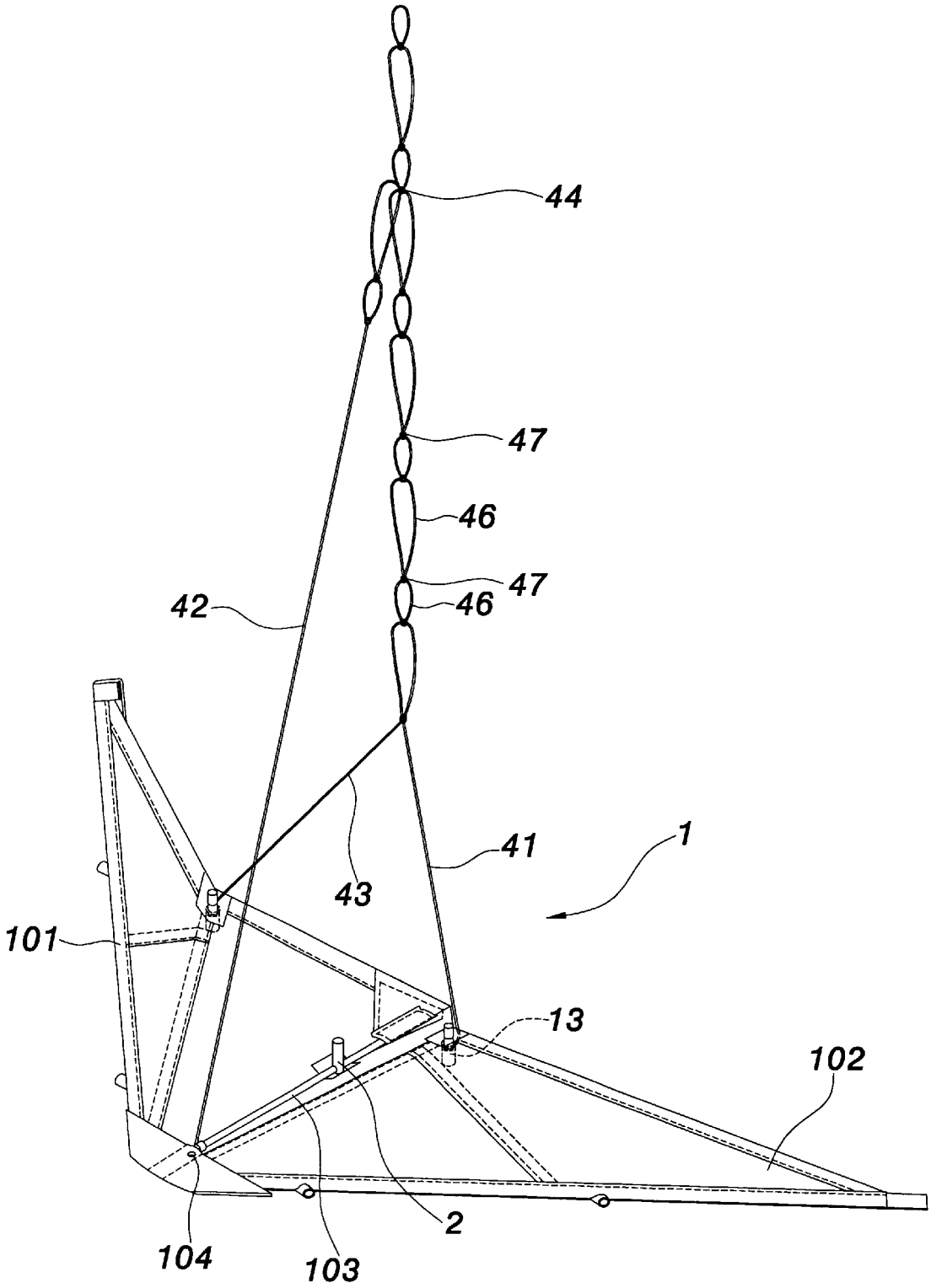
FIG. 6B is a view showing another way how the bridles of the present invention are tied.

As shown in FIG. 5B, the stunt kite 10 can be directly hung at a ceiling, a girdle, or a proper place via an adhesive tape, a suction disk, or a hook ring 63. When the stunt kite 10 is hung at a place where air flows such as the place in front of the wind outlet of an air-conditioner or a fan, it will rotate, hover, and fly along with the wind. FIG. 5B shows an embodiment of the present invention, wherein the stunt kite 10 is hung at the hook ring 63. As shown in FIGS. 6A and 6B, because the three bridles 41, 42, and 43 at the upper side or the lower side of the stunt kite 10 are joined together at the connection point 44 through slipknots, and because a plurality of positioning points 46 and positioning knots 47 are arranged on the bridle 41, the position of the connection point 44 of the three bridles 41, 42, and 43 can be changed. That is, the three bridles 41, 42, and 43 can be joined at different positioning knots 47. The stunt kite 10 can be hung at different angles by changing the position of the connection point or by hooking the hook 81 at different positioning points 46. When the stunt kite 10 is pulled, it can make right or left rotation, waft, and tumbling of different angles. FIGS. 6A and 6B are views showing two different ways how the bridles of the present invention are tied.

Figure 7:
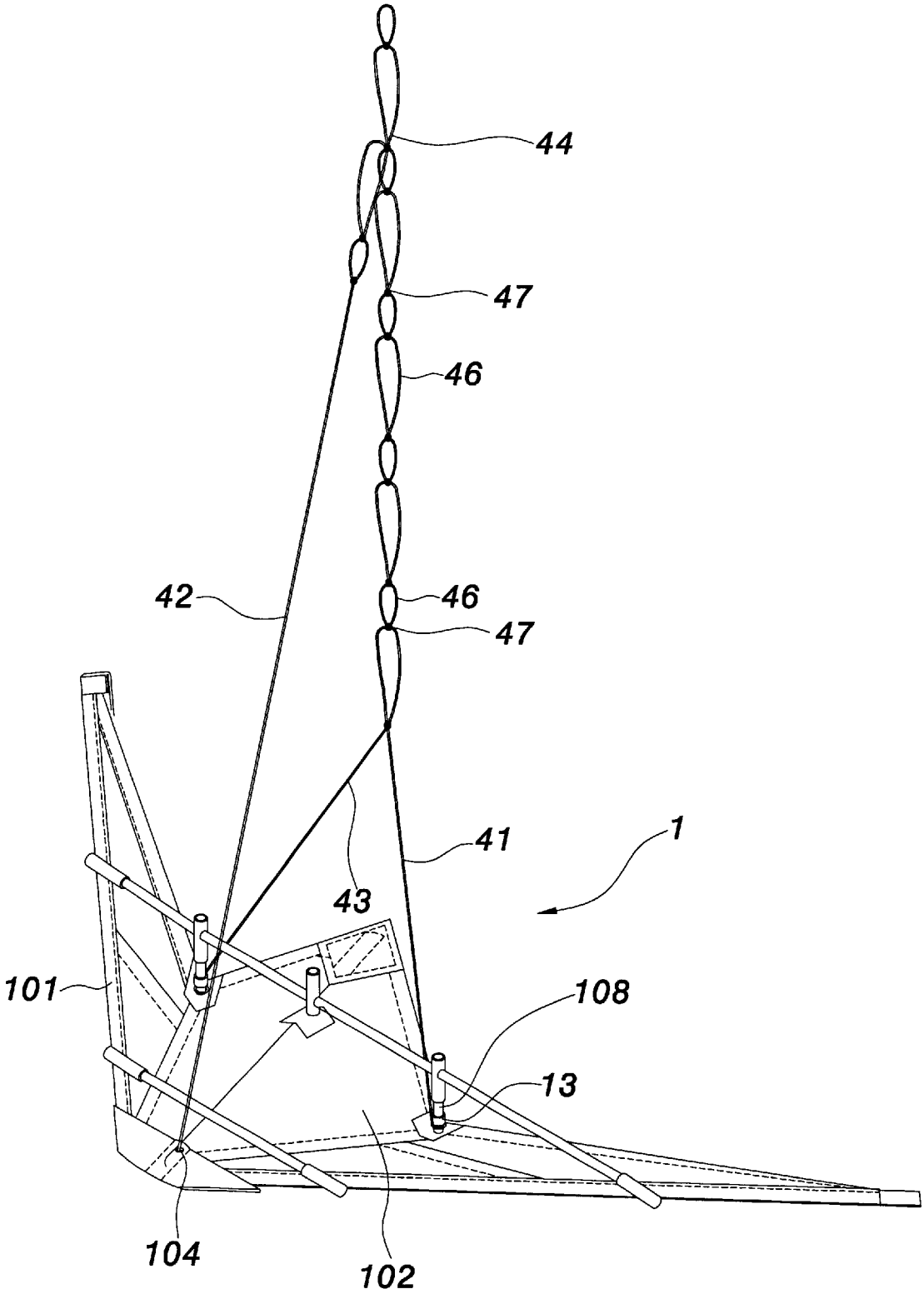
FIG. 7 is a view showing the situation that the bridles of the present invention penetrate to the other surface.

In the present invention, a string hole 104 is formed at the front section of the covering cloth 102 so that the bridles 41,

42, and 43 can be placed convertibly at the upper side or the lower side of the stunt kite 10. FIG. 7 shows the situation that the three bridles 41, 42, and 43 penetrate to the lower side of the kite body 1 through the string hole 104.

As shown in FIG. 2, a fragrant box 7 is fixedly installed at a predetermined position of the kite body 1 so that when the stunt kite 10 is hung, the fragrant box can emit aroma. In other words, the stunt kite 10 can be used as a decoration, which can emit aroma.

In the above embodiments of the present invention, the stunt kite can be of any size. Large-sized stunt kites of the present invention can be used unrestrictedly outdoors, but they can only be operated to fly or be hung as a decoration in a spacious and tall indoor space. On the other hand, small- and middle-sized stunt kites of the present invention can be operated to fly or be hung as a decoration in a common residence. In other words, the usage of the stunt kites of the present invention is wider than that of prior art stunt kites.

To sum up, a multi-functional stunt kite of the present invention not only can make stunt flights in the sky, but also can be used as a decoration, which can emit aroma.

Although the present invention has been described with reference to the preferred embodiments thereof, it will be understood that the invention is not limited to the details thereof. Various substitutions and modifications have been suggested in the foregoing description, and others will occur to those of ordinary skill in the art. Therefore, all such substitutions and modifications are intended to be embraced within the scope of the invention as defined in the appended claims.

I claim:

1. A multi-functional stunt kite having a kite body comprising a plurality of struts and a covering cloth, two sets of control strings being connected near two lateral wings at a lower side of said kite body, said control strings being connected to two flying strings for controlling flying directions of said kite body so that said kite body performs various kinds of stunt flights, characterized in that:

jointing tubes penetrating from upper side to lower side of said kite body, a keel strut and retaining blocks being joined at predetermined points of said kite body, a plurality of bridles being respectively connected on a top surface of said kite body, one end of said bridles being actively or fixedly joined together by means of slipknots so that connection points of said bridles is movable, positioning points joining with said connection point, said connection point being guided in a hook ring after joining with strings and an elevating string so that the hung angle of said stunt kite can be changed along with the change of the position of said connection point or said positioning points of said bridles.

2. The multi-functional stunt kite as claimed in claim 1, wherein a supporting rod or a spring can be installed on said jointing tube situated at the upper side or the lower side of said stunt kite, and the other end of said supporting rod or said spring can join with a suction disk or can be directly inserted into a short post on a suction disk.

3. The multi-functional stunt kite as claimed in claim 2, wherein the other end of said supporting rod or said spring can join with a weighted block or can be directly inserted into a short post on a weighted block.

4. The multi-functional stunt kite as claimed in claim 1, wherein a plurality of bridles are respectively connected to points on the top surface near the head and the two lateral wings of said kite body, the other end of said bridles are joined together by means of slipknots, and one of said bridles has a plurality of positioning points and positioning knots.

5. The multi-functional stunt kite as claimed in claim 1, wherein one end of said bridles are fixedly arranged on a strut installed on said kite body, and retaining blocks are telescoped at predetermined points of said strut so as to prevent said bridles from sliding or detaching.

6. The multi-functional stunt kite as claimed in claim 1, wherein said stunt kite joins at a rotation hook via a lift string, and said stunt kite can rotate in the air via said rotation hook while said bridles and related strings will not tangle.

7. The multi-functional stunt kite as claimed in claim 6, wherein an elevating string joins with the other joining point of said rotation hook, and a handgrip of said elevating string is pulled to control the elevation of said stunt kite so that it can jump and fly when there is no wind.

8. The multi-functional stunt kite as claimed in claim 1, wherein said strings and said elevating string crosses in said hook ring, said strings can be tied at a fixed hook ring, and two or more hook rings can be installed to be spaced at a predetermined distance so that said stunt kite will not tangle with said elevating string when said stunt kite is pulled.

9. The multi-functional stunt kite as claimed in claim 7, wherein said elevating string can join with a string or a plurality of strings and a plurality of stunt kites so as to let one stunt kite or a plurality of stunt kites jump and fly simultaneously when said elevating string is pulled.

10. The multi-functional stunt kite as claimed in claim 1, wherein said bridles and said strings can be separately tied on said hook ring or a hole of a suction disk to be hung at a place where air flows so that said stunt kite can hover, fly, and flip through the help of the wind.

11. The multi-functional stunt kite as claimed in claim 1, wherein said keel strut can extend out of the head and the tail of said stunt kite, and retaining blocks are installed in two ends of said keel strut, one or more propeller being installed at the head or the tail of said keel strut, positioning blocks being arranged in front of and behind said propeller, said stunt kite being capable of being placed at a wind outlet so as to let said propeller rotate.

12. The multi-functional stunt kite as claimed in claim 11, wherein a gripper can be installed at the other end of said keel strut where no propeller is installed so as to grip at a wind outlet or a proper position.

13. The multi-functional stunt kite as claimed in claim 1, wherein said jointing tubes at the lower side of a stunt kite can join with supporting rods or suction disks, and said jointing tubes at the upper side of said stunt kite and at the lower side of another stunt kite can be joined together via supporting rods so that a plurality of said stunt kites can be telescoped and stacked together.

14. The multi-functional stunt kite as claimed in claim 4, wherein a string hole is formed at the front section of said covering cloth of said stunt kite, said bridles at the front section can be installed at the upper side or the lower side of said stunt kite, while said bridles at the rear section can be pulled toward the upper side or the lower side of said stunt kite to be joined with said bridles at the front section so that said bridles can be placed convertibly at the upper side or the lower side of said stunt kite, said stunt kite being capable of hovering, flying, and flipping with the upper side or the lower side thereof up.

15. The multi-functional stunt kite as claimed in claim 1, wherein rubber bands or resilient devices can be joined between said lift string and said strings to let said stunt kite have better resilient and buffering effects.

16. The multi-functional stunt kite as claimed in claim 1, wherein a fragrant box can be fixedly installed at a predetermined position of said kite body so as to emit aroma when said stunt kite is hung to rotate at a place where air flows.

17. The multi-functional stunt kite as claimed in claim 6, wherein a rotation hook can be installed at one end of said lift string and said positioning points where they join with said strings, and said rotation hook can be used to facilitate the change of said positioning points and the detachment or hanging of said stunt kite.

* * * * *